US010591144B2

(12) United States Patent
Im et al.

(10) Patent No.: US 10,591,144 B2
(45) Date of Patent: Mar. 17, 2020

(54) LIGHTING APPARATUS

(71) Applicant: LG INNOTEK CO., LTD., Seoul (KR)

(72) Inventors: Chang Hyuk Im, Seoul (KR); Hwa Young Kim, Seoul (KR); Sang Hoon Park, Seoul (KR)

(73) Assignee: LG Innotek Co., Ltd., Seoul (KR)

( * ) Notice: Subject to any disclaimer, the term of this patent is extended or adjusted under 35 U.S.C. 154(b) by 0 days.

(21) Appl. No.: 16/098,201

(22) PCT Filed: May 2, 2017

(86) PCT No.: PCT/KR2017/004638
§ 371 (c)(1),
(2) Date: Nov. 1, 2018

(87) PCT Pub. No.: WO2017/191967
PCT Pub. Date: Nov. 9, 2017

(65) Prior Publication Data

US 2019/0162395 A1 May 30, 2019

(30) Foreign Application Priority Data

May 2, 2016 (KR) ..... 10-2016-0053968

(51) Int. Cl.
*F21V 21/02* (2006.01)
*F21S 8/04* (2006.01)
(Continued)

(52) U.S. Cl.
CPC ..... *F21V 21/02* (2013.01); *F21K 9/23* (2016.08); *F21S 2/00* (2013.01); *F21S 8/04* (2013.01);
(Continued)

(58) Field of Classification Search
CPC ..... F21V 21/02; F21V 21/03; F21V 23/023; F21S 8/043; F21S 8/04
(Continued)

(56) References Cited

U.S. PATENT DOCUMENTS 5,526,251 A * 6/1996 Andre ..... F21V 21/03 248/906
10,208,930 B1 * 2/2019 Hsu ..... F21V 17/12
(Continued)

FOREIGN PATENT DOCUMENTS

JP H 09-219111 8/1997
JP 2011-100688 5/2011
(Continued)

OTHER PUBLICATIONS

International Search Report (with English Translation) and Written Opinion dated Aug. 8, 2017 issued in Application No. PCT/KR2017/004638.

*Primary Examiner* — Christopher M Raabe
(74) *Attorney, Agent, or Firm* — KED & Associates, LLP

(57) ABSTRACT

Disclosed is a lighting apparatus comprising: a light source unit emitting light from the front side; a plate coupled to the back side of the light source unit and comprising a through hole which is formed on the center; and a holder disposed between the light source unit and the plate and comprising an accommodation groove which is formed on the side facing the through hole, wherein the accommodation groove has a first width in a first direction and a second width in a second direction intersecting the first direction, wherein the first width is greater than the diameter of the through hole and the second width is less than the diameter of the through hole.

8 Claims, 8 Drawing Sheets

(51) Int. Cl.

| | |
|---|---|
| ***F21V 15/01*** | (2006.01) |
| ***F21K 9/23*** | (2016.01) |
| ***F21S 2/00*** | (2016.01) |
| ***F21V 23/02*** | (2006.01) |
| *F21Y 103/33* | (2016.01) |
| *F21Y 115/10* | (2016.01) |

(52) U.S. Cl.
CPC ..... *F21V 15/01* (2013.01); *F21V 23/023* (2013.01); *F21Y 2103/33* (2016.08); *F21Y 2115/10* (2016.08)

(58) Field of Classification Search
USPC ..... 362/362
See application file for complete search history.

(56) References Cited

U.S. PATENT DOCUMENTS

2008/0170398 A1* 7/2008 Kim ..... F21V 21/002 362/260
2013/0020955 A1* 1/2013 Igaki ..... H05B 33/0803 315/201
2018/0010779 A1* 1/2018 Zhou ..... F21V 25/00

FOREIGN PATENT DOCUMENTS

KR 20-0457111 12/2011
KR 10-1170374 8/2012
WO WO 2014/041810 3/2014

* cited by examiner

LIGHTING APPARATUS

CROSS-REFERENCE TO RELATED PATENT APPLICATIONS

This application is a U.S. National Stage Application under 35 U.S.C. § 371 of PCT Application No. PCT/KR2017/004638, filed May 2, 2017, which claims priority to Korean Patent Application No. 10-2016-0053968, filed May 2, 2016, whose entire disclosures are hereby incorporated by reference.

TECHNICAL FIELD

The present invention relates to a lighting apparatus.

BACKGROUND ART

A light emitting diode (LED) is a kind of semiconductor element configured to convert electric energy into light. LEDs have advantages of low power consumption, semi-permanent lifetime, fast response speed, safety, and environmental friendliness compared to conventional light sources such as fluorescent lamps and incandescent lamps. Accordingly, studies for replacing the conventional light sources with LEDs are widely being conducted.

Recently, the LEDs have been increasingly used as light sources for lighting apparatuses such as various liquid crystal displays, electric sign boards, and street lamps used indoors and outdoors. The lighting apparatus using the LED as a light source includes a light source member having a printed circuit board (PCB) on which LEDs are mounted.

A general lighting apparatus includes a hole formed at a center of a case for installing. Accordingly, there is a problem in that a dark portion is generated at the center.

In addition, since an inside of the lighting apparatus has to be opened to separate the lighting apparatus from a ceiling and closed, a safety problem may occur, and there may be problems in that installation and separation are complicated.

DISCLOSURE

Technical Problem

The present invention is directed to providing a lighting apparatus which is easy to install and separate.

In addition, the present invention is directed to providing a lighting apparatus having excellent safety while being installed and separated.

In addition, the present invention is directed to providing a lighting apparatus in which a dark portion of a central portion thereof is removed and the uniformity thereof is excellent.

Technical Solution

One aspect of the present invention provides a lighting apparatus including: a light source unit; a plate coupled to the light source unit and including a through hole formed at a center of the plate; and a holder interposed between the light source unit and the plate and including an accommodation groove formed in a surface which faces the through hole, wherein the accommodation groove includes a first width in a first direction and a second width in a second direction which intersects with the first direction, and the first width is greater than a diameter of the through hole, and the second width is less than the diameter of the through hole.

The holder may include a first sidewall and a second sidewall which face each other, and a third sidewall and a fourth side wall which are connected between the first sidewall and the second sidewall and face each other, wherein the first width may be a distance from the first sidewall to the second sidewall, and the second width may be a distance from the third sidewall to the fourth sidewall.

The first sidewall and the second sidewall may have curvatures.

The third sidewall and the fourth sidewall may have flat surfaces.

The holder may include a first corner at which the first sidewall intersects with the third sidewall, and a second corner at which the second sidewall intersects with the fourth sidewall.

The holder may include a first protrusion which protrudes from the first corner toward a center of the holder, and a second protrusion which protrudes from the second corner toward the center.

The light source unit may include: a case having open one side; a circuit board disposed in the case; a plurality of light-emitting elements disposed on the circuit board; and a cover coupled to the one side of the case.

The case may include a concave groove which is formed in a central portion and is concave toward the cover.

A power source unit may be interposed between the case and the plate, and the power source unit may include a substrate installed in the case and a plurality of electronic components accommodated in the concave groove.

The circuit board may have a ring shape and be disposed at an edge portion of the case, and the plurality of light-emitting elements disposed on the circuit board may face each other.

Another aspect of the present invention provides a lighting apparatus including: a light source unit; a plate coupled to the light source unit and including a through hole formed at a center of the plate; a holder interposed between the light source unit and the plate and including an accommodation groove formed in a surface which faces the through hole; and a socket including a body accommodated in the accommodation groove of the holder and a plurality of protruding steps which protrude outward from the body, wherein the plurality of protruding steps are inserted into the body by a sidewall of the accommodation groove when the holder rotates.

The accommodation groove of the holder may have a first width in a first direction and a second width in a second direction, the first width of the accommodation groove of the holder may be greater than a first diameter of a virtual circle formed by extending outer surfaces of the plurality of protruding steps, and the second width of the accommodation groove of the holder may be less than the first diameter of the virtual circle formed by extending the outer surfaces of the plurality of protruding steps.

The holder may include a first sidewall and a second sidewall which face each other, and a third sidewall and a fourth sidewall which are connected between the first sidewall and the second sidewall and face each other, wherein the first width may be a distance from the first sidewall to the second sidewall, and the second width may be a distance from the third sidewall to the fourth sidewall.

The holder may include a first corner at which the first sidewall intersects with the third sidewall and a second corner at which the second sidewall intersects with the fourth sidewall.

The holder may include a first protrusion which protrudes from the first corner toward a center of the holder, and a second protrusion which protrudes from the second corner toward the center.

When the holder rotates in the first direction, rotation of the protruding steps of the socket may be restricted by the first corner and the second corner, and when the holder rotates in a direction opposite the first direction, the protruding steps of the socket may be inserted into the body by the third sidewall and the fourth sidewall.

Advantageous Effects

According to embodiments, a lighting apparatus is easily installed and separated.

In addition, since light-emitting elements and electronic components are not exposed to the outside when the lighting apparatus is installed and separated, safety thereof is excellent.

In addition, since a dark portion of a central portion of the lighting apparatus is removed, the uniformity thereof is excellent.

A variety of useful advantages and effects are not limited to the above-described contents and will be more easily understood when specific embodiments of the present invention are described.

MODES OF THE INVENTION

The embodiments of the present invention may be modified into different forms or the plurality of embodiments may be combined, and the scope of the present invention is not limited to the embodiments which will be described below.

Although a description given in a specific embodiment is not given in other embodiments, the description may be understood to be descriptions of the other embodiments as long as there are no opposing or inconsistent descriptions given.

For example, when a feature of an element A is described in a specific embodiment and a feature of an element B is described in another embodiment, the scope of the present invention includes an embodiment in which the elements A and B are combined even when the embodiment is not clearly described as long as there are no opposing or inconsistent descriptions given.

In a description of the embodiment, in a case in which any one element is described as being formed on (or under) another element, such a description includes both a case in which the two elements are formed to be in direct contact with each other and a case in which the two elements are in indirect contact with each other such that one or more other elements are interposed between the two elements. In addition, when in a case in which one element is described as being formed on (or under) the other element, such a description may include a case in which one element is formed at an upper side or a lower side with respect to the other element.

Hereinafter, the embodiments of the present invention will be described in detail with reference to the accompanying drawings so that those skilled in the art may easily perform the present invention.

Figure 1:
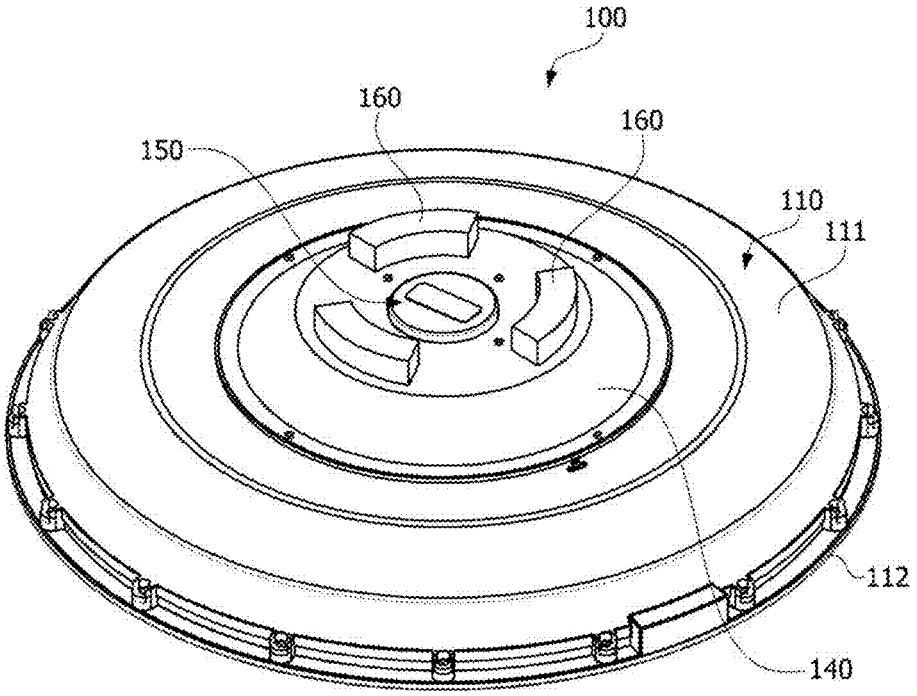
FIG. 1 is a perspective view illustrating a lighting apparatus according to one embodiment of the present invention.
Figure 2:
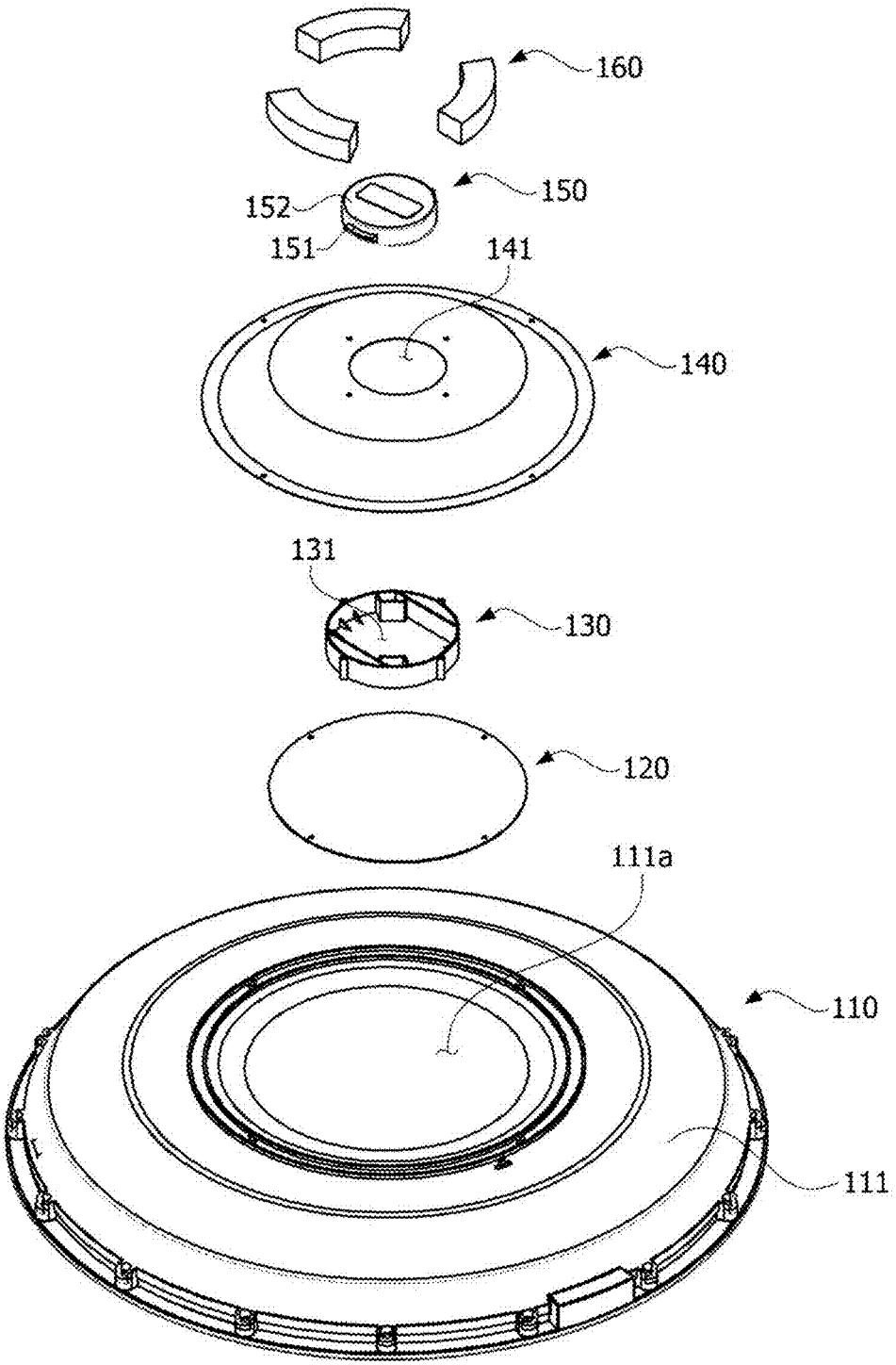
FIG. 2 is an exploded perspective view of FIG. 1.

FIG. 1 is a perspective view illustrating a lighting apparatus according to one embodiment of the present invention, and FIG. 2 is an exploded perspective view of FIG. 1.

Referring to FIGS. 1 and 2, a lighting apparatus 100 according to the embodiment includes a light source unit 110, a plate 140 coupled to the light source unit 110, a holder 130 interposed between the light source unit 110 and the plate 140, and a socket 150 inserted into the holder 130.

A plurality of light sources may be disposed in a case 111, which have a circular plate shape, of the light source unit 110. A structure of the light source unit 110 is not specifically limited. For example, any structure of general lighting apparatuses may be applied to the light source unit 110.

The case 111 may include a concave groove 111*a* formed at a center thereof. A power source unit 120 may be disposed in the concave groove 111*a*. A plurality of electronic components (power components and the like) mounted on the power source unit 120 may be accommodated in the concave groove 111*a*.

A hole may be formed in a central portion of a case 111 of a conventional lighting apparatus 100. Such a hole may form a space for electrically connecting the conventional lighting apparatus 100 to a socket 150 installed on a ceiling. In addition, the hole may form a space for separating the lighting apparatus 100 from the socket 150. However, when the hole having a size greater than a predetermined size is formed at a center of the case, there is a problem in that a dark portion is generated at the central portion.

A hole is not formed at the center of the case 111 according to the embodiment. Accordingly, since light may also be controlled at the center of the case 111, uniform light can be emitted in a forward direction.

The lighting apparatus 100 according to the embodiment may be installed on a ceiling using the plate 140 and the holder 130.

The plate 140 is convexly formed in an opposite direction of the light source unit 110 to form a space thereinside, and a through hole 141 may be formed at a center of the plate 140. The plate 140 may be coupled to a back side of the case 111 by a screw and the like. The plate 140 may have a diameter wide enough to cover the concave groove of the case 111.

The holder 130 may be interposed between the case 111 and the plate 140 and fixed to the plate 140 by a screw and the like. An insertion groove 131 may be formed in a surface, which faces the through hole 141, of the holder 130.

The socket 150 may include protruding steps 151 protruding outward from a body 152 having a cylindrical shape.

Because the socket 150 is fixed to the holder 130 through the through hole 141 of the plate 140, the plate 140 may be fixed to the ceiling. Accordingly, the light source unit 110 coupled to the plate 140 may be fixed to the ceiling. The socket 150 may be electrically connected to a power connector (not shown) buried in the ceiling.

Pads 160 may be attached to one surface of the plate 140 to serve as cushions between the ceiling and the lighting apparatus 100 when the lighting apparatus 100 is fixed to the ceiling. The pads 160 are not specifically limited as long as being formed of a flexible material.

Figure 3:
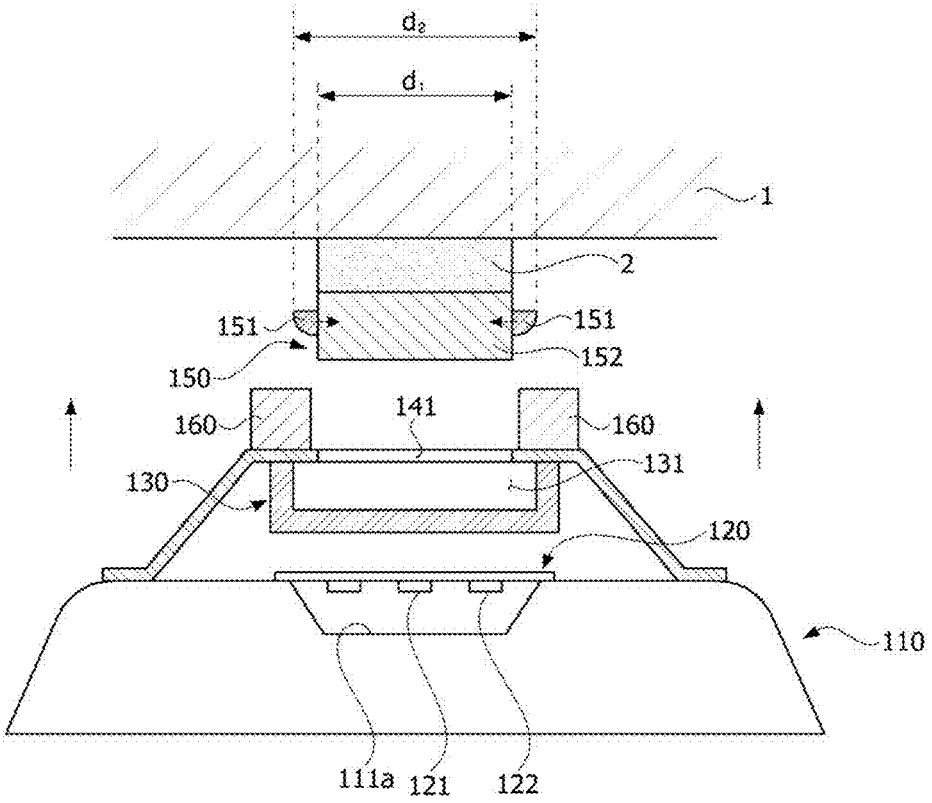
FIGS. 3 and 4 are views for describing a configuration for fixing the lighting apparatus to a wall surface.
Figure 4:
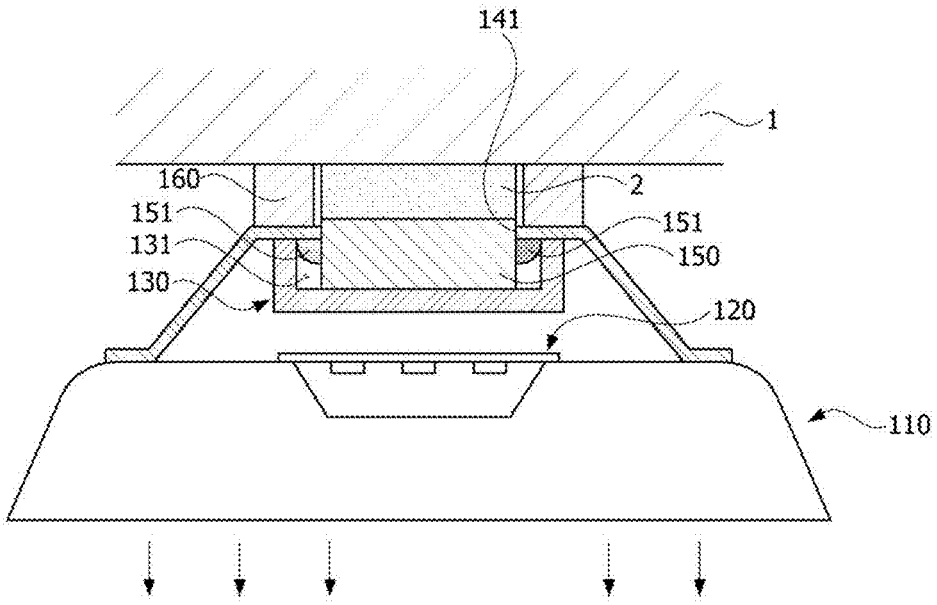

FIGS. 3 and 4 are views for describing a configuration for fixing the lighting apparatus to a wall surface.

Referring to FIG. 3, a power connector 2 and the socket 150 may be disposed in a ceiling 1 of a house or building. A structure including the power connector 2 and the socket 150 may be a common structure disposed in a general house or the building in advance. A diameter d1 of the body 152 of the socket 150 may correspond to a diameter of the through hole 141 of the plate 140.

The protruding steps 151 may protrude outward from the body 152. Accordingly, a diameter d2 of the protruding steps 151 may be greater than the diameter d1 of the body 152 and the diameter of the through hole 141.

Because the protruding steps 151 protrude due to elastic members such as a spring, when the protruding steps 151 are pressed, the protruding steps 151 may be inserted into the body 152.

Although not illustrated in the drawings, a cable extending from the socket 150 may be electrically connected to the power source unit 120. Accordingly, external power may be applied to the lighting apparatus 100 through the socket 150.

The holder 130 may be spaced a predetermined distance from the power source unit 120. Because a large amount of heat is radiated by various electronic components 121 and 122 of the power source unit 120 when the power source unit 120 operates, the power source unit 120 may be spaced the predetermined distance from the holder 130 such that the large amount of heat is cooled through convention current. Particularly, when a material of the holder 130 is plastic, the power source unit 120 needs to be spaced a sufficient distance from the holder 130.

Referring to FIG. 4, when the lighting apparatus 100 is pushed upward toward the ceiling 1, the socket 150 is accommodated in an accommodation groove 131 of the holder 130. Here, the protruding steps 151 are inserted into the through hole 141 of the plate 140. Accordingly, the lighting apparatus 100 may be fixed to the ceiling. Here, the plurality of pads 160 may serve as cushions between the ceiling and the plate 140.

Figure 5:
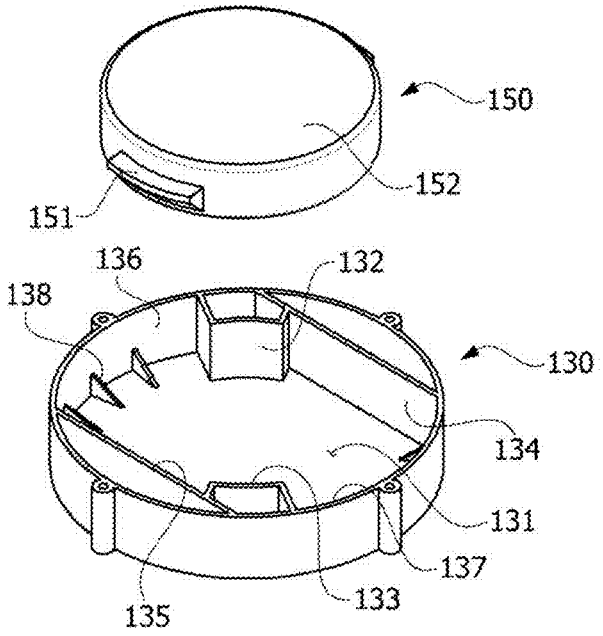
FIG. 5 is a view for describing a socket and a holder.
Figure 6:
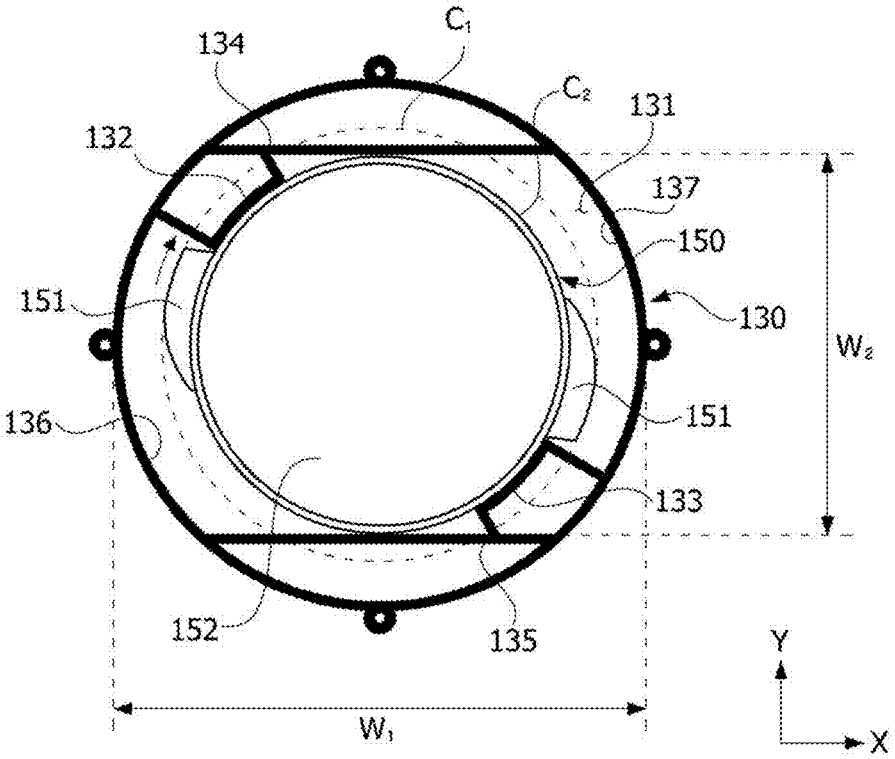
FIG. 6 is a view for describing a process in which the socket and the holder are coupled.
Figure 7:
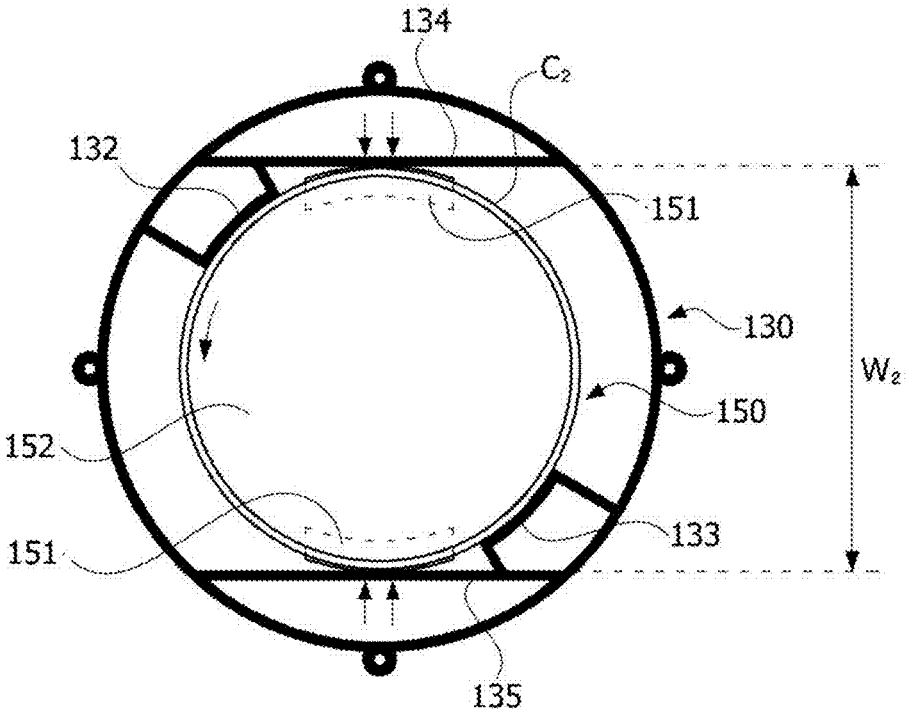
FIG. 7 is a view for describing a process in which the socket is separated from the holder.

FIG. 5 is a view for describing a socket and a holder, FIG. 6 is a view for describing a process in which the socket and the holder are coupled, and FIG. 7 is a view for describing a process in which the socket is separated from the holder.

The socket 150 includes the body 152 accommodated in the holder 130, and the plurality of protruding steps 151 protruding outward from the body 152. Ends of the protruding steps 151 may be formed to protrude away from the holder 130. According to such a structure, the socket 150 may be easily coupled to the through hole 141 of the plate 140, and after the coupling, the socket 150 and the through hole 141 may be prevented from being easily separated.

The holder 130 may include the accommodation groove 131 in which the socket 150 is accommodated. The accommodation groove 131 includes a first sidewall 136 and a second sidewall 137 which face each other, and a third sidewall 134 and a fourth sidewall 135 which face each other. The first sidewall 136 and the second sidewall 137 may have curvatures, and the third sidewall 134 and the fourth sidewall 135 may have flat surfaces.

The accommodation groove 131 may include a first protrusion 132 formed at a first corner at which the first sidewall 136 intersects with the third sidewall 134, and a second protrusion 133 formed at a second corner at which the second sidewall 137 intersects with the fourth sidewall 135. In addition, the accommodation groove 131 may further include reinforcing portions 138 which enhance strengths of the sidewalls and a bottom surface.

Referring to FIG. 6, when the socket 150 passes through the plate and is accommodated in the accommodation groove 131, the socket 150 may be completely coupled to the holder 130 by being rotated in a first direction. That is, the first protrusion 132 and the second protrusion 133 may serve as stoppers.

The accommodation groove 131 may have a first width W1 between the first sidewall 136 and the second sidewall 137 in the first direction (X direction) and a second width W2 between the third sidewall 134 and the fourth sidewall 135 in a second direction (Y direction).

Here, a diameter of a virtual circle C1 formed by connecting the plurality of protruding steps 151 may be less than the first width W1, but greater than the second width W2. Accordingly, while the socket 150 is inserted into the accommodation groove 131 and rotated in a first rotating direction, since the protruding steps 151 rotate within the first width W1, the diameter of the virtual circle C1 may be maintained without change.

Referring to FIG. 7, in a case in which the light source unit is rotated in a second rotating direction to separate the lighting apparatus, the holder 130 connected to the light source unit is rotated in the second rotating direction. The first rotating direction may be the clockwise direction and the second rotating direction may be the counterclockwise direction, but are not limited thereto.

When the holder 130 rotates in the second rotating direction, the protruding steps 151 of the socket 150 come into contact with the third sidewall 134 and the fourth sidewall 135 of the accommodation groove 131. As described above, since the second width W2 between the third sidewall 134 and the fourth sidewall 135 is less than the virtual circle C1 formed by connecting the protruding steps 151, the protruding steps 151 are pressed by the third sidewall 134 and the fourth sidewall 135 and thus inserted into the body 152. Accordingly, since a diameter of the socket 150 is the same as the diameter of the through hole of the plate 140, the lighting apparatus 100 may be separated from the socket 150 attached to the ceiling.

That is, when the socket 150 is coupled to the holder 130, the protruding steps 151 of the socket 150 may be pressed due to the second width W2 between the third sidewall 134 and the fourth sidewall 135 and inserted into the body 152 as illustrated in FIG. 7. Subsequently, the protruding steps 151 of the socket 150 may protrude due to rotation of the holder 130 and enter a state of FIG. 6.

In addition, when the socket 150 is separated from the holder 130, the holder 130 rotates in the state of FIG. 6, the protruding steps 151 of the socket 150 are pressed due to the second width W2 as illustrated in FIG. 7, and thus the socket 150 may be separated from the holder 130.

Figure 8:
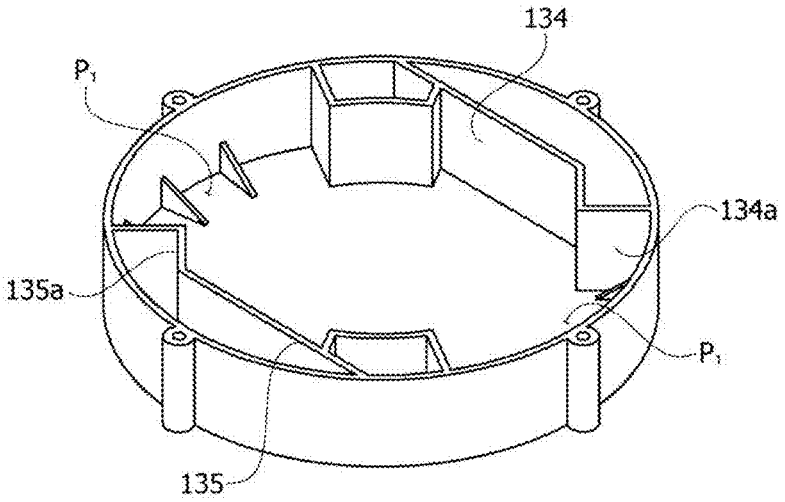
FIG. 8 is a view illustrating a first modified example of the socket.
Figure 9:
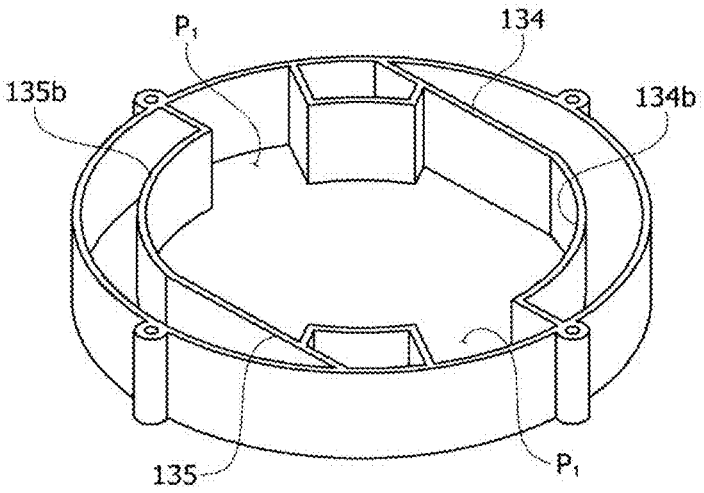
FIG. 9 is a view illustrating a second modified example of the socket.

FIG. 8 is a view illustrating a first modified example of the socket, and FIG. 9 is a view illustrating a second modified example of the socket.

Referring to FIG. 8, ends 134*a* and 135*a* of a third sidewall 134 and a fourth sidewall 135 of a holder 130 may protrude, and referring to FIG. 9, ends 134*b* and 135*b* thereof may also be rounded. According to such a configuration, pockets P1 in which protruding steps 151 are disposed may be formed to prevent a problem in that a lighting apparatus 100 arbitrarily rotates, and there is an advantage in that the protruding steps 151 of a socket 150 can be easily guided when the holder 130 is separated from the socket 150.

Figure 10:
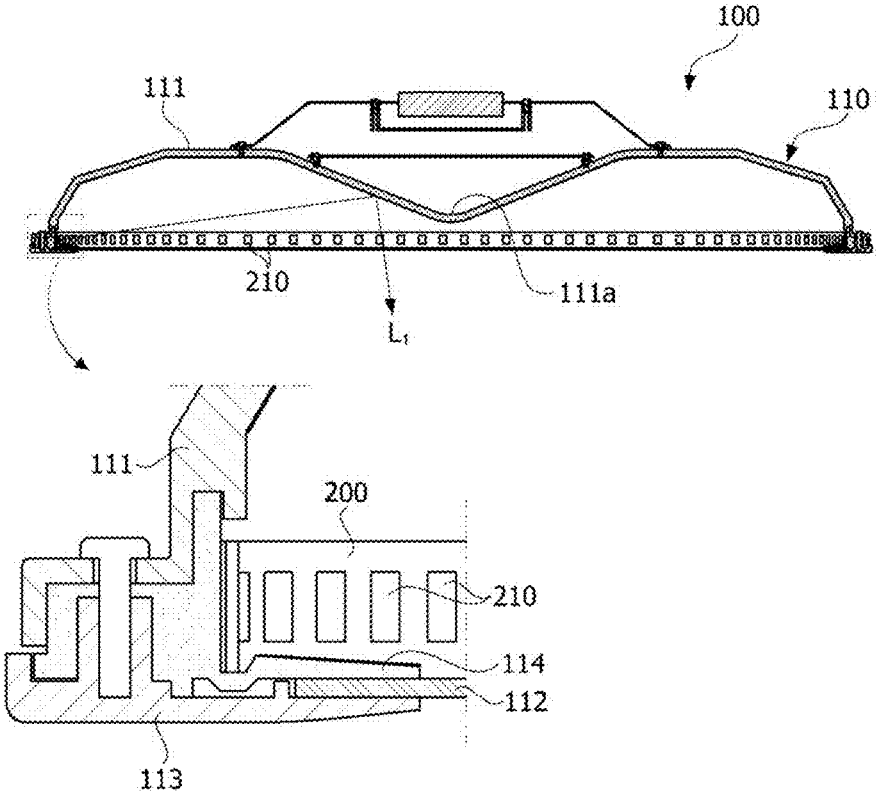
FIG. 10 is a view for describing a structure of a light source unit according to the embodiment.
Figure 11:
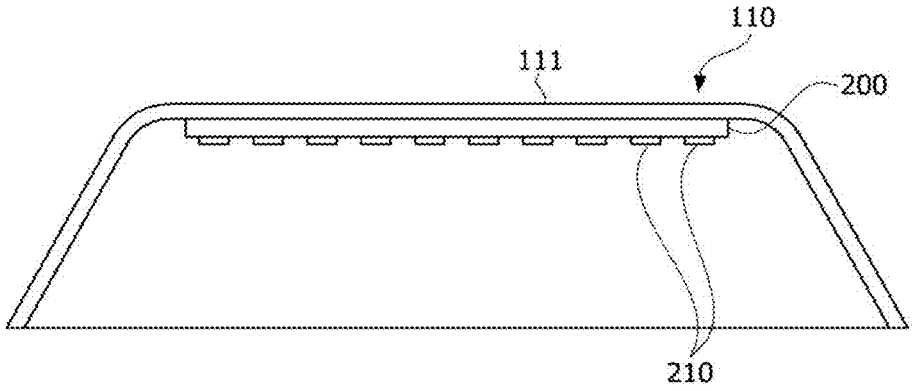
FIG. 11 is a view illustrating a modified example of FIG. 10.

FIG. 10 is a view for describing a structure of the light source unit according to the embodiment, and FIG. 11 is a view illustrating a modified example of FIG. 10.

Referring to FIG. 10, the light source unit 110 includes the case 111 having open one side, a circuit board 200 disposed in the case 111, a plurality of light-emitting elements 210 disposed on the circuit board 200, and a cover 112 coupled to the one side of the case 111.

The case 111 may include a first bracket 114 and a second bracket 113 each having a ring shape. Each of the first bracket 114 and the second bracket 113 has the ring shape, and the cover 112 may be fixed to a gap between the first bracket 114 and the second bracket 113.

The circuit board 200 in a ring shape may be disposed on an inner surface of the first bracket 114. Accordingly, the plurality of light-emitting elements 210 disposed on the circuit board 200 may also be disposed in a ring shape to face each other.

Light L1 emitted by the light-emitting elements 210 may be reflected and controlled by the case 111. An inner surface of the case 111 may include a light reflective material. The case 111 may include white silicone such as phenyl silicone and methyl silicone, or have a structure in which reflective particles are further added to the white silicone to increase reflectivity. For example, the case 111 may be glass in which TiO2 is dispersed, but is not limited thereto. The above-described inner surface of the case 111 may perform diffuse reflection on light emitted by the light-emitting elements 210, and reflect the incident light toward the cover 112 with a Lambertian distribution.

The case 111 may have a shape capable of controlling light. For example, a central portion of the case 111 may be concave such that incident light is reflected toward the cover 112. Here, since a hole is not formed in a central portion 111*a* of the case 111 according to the embodiment, the case 111 may be designed such that incident light is reflected. Accordingly, since light of a central region of the lighting apparatus 100 is controllable, generation of a dark portion can be prevented.

The case 111, the first bracket 114, and the second bracket 113 may be coupled by coupling members such as screws, or may also be attached to each other by adhesives, but are not limited thereto.

Referring to FIG. 11, a light source unit 110 according to the embodiment may also be a direct type light source unit. According to such a configuration, a problem in which dark portions are generated at a central portion and an edge portion can be solved.

The invention claimed is:

1. A lighting apparatus comprising:

a light source unit configured to emit light in a forward direction;

a plate coupled to a back side of the light source unit and including a through hole formed at a center of the plate;

a holder interposed between the light source unit and the plate and including an accommodation groove which faces the through hole, wherein the accommodation groove of the holder includes:

a first sidewall and a second sidewall which face each other; and a third sidewall and a fourth side wall which are connected between the first sidewall and the second sidewall and face each other, wherein the accommodation groove includes a first width which extends in a first direction from the first sidewall to the second sidewall, and a second width which extends in a second direction which intersects with the first direction and which extends in the second direction from the third sidewall to the fourth sidewall, and a socket that includes a body to accommodate in the accommodation groove of the holder and a plurality of protruding steps that selectively protrude outward from the body and insert inwardly from the body based on location of the protruding steps with respect to different ones of the sidewalls, wherein the protruding steps move to insert inwardly from the body when the protruding steps contact the third sidewall and the fourth sidewall, the first width between the first sidewall and the second sidewall is greater than a diameter of the through hole of the plate, and the second width between the third sidewall and the fourth sidewall is less than the diameter of the through hole of the plate.

2. The lighting apparatus of claim 1, wherein:

the first sidewall and the second sidewall have curvatures; and the third sidewall and the fourth sidewall have flat surfaces.

3. The lighting apparatus of claim 1, further comprising:

a first corner at which the first sidewall intersects with the third sidewall;

a second corner at which the second sidewall intersects with the fourth sidewall;

a first protrusion which protrudes from the first corner toward a center of the holder; and a second protrusion which protrudes from the second corner toward the center.

4. The lighting apparatus of claim 1, wherein the light source unit includes:

a case having open one side;

a circuit board disposed in the case;

a plurality of light-emitting elements disposed on the circuit board; and a cover coupled to the one side of the case.

5. The lighting apparatus of claim 4, wherein:

the case includes a concave groove which is formed in a central portion and is concave toward the cover;

a power source unit is interposed between the case and the plate; and the power source unit includes a substrate installed in the case and a plurality of electronic components accommodated in the concave groove.

6. The lighting apparatus of claim 4, wherein:

the circuit board has a ring shape and is disposed at an edge portion of the case; and the plurality of light-emitting elements disposed on the circuit board face each other.

7. The lighting apparatus of claim 1, wherein:

the first width of the accommodation groove of the holder is greater than a first diameter of a virtual circle formed by extending outer surfaces of the plurality of protruding steps; and the second width of the accommodation groove of the holder is less than the first diameter of the virtual circle formed by extending the outer surfaces of the plurality of protruding steps.

8. The lighting apparatus of claim 7, wherein the holder includes:

a first corner at which the first sidewall intersects with the third sidewall;

a second corner at which the second sidewall intersects with the fourth sidewall;

a first protrusion which protrudes from the first corner toward a center of the holder; and a second protrusion which protrudes from the second corner toward the center, wherein rotation of the protruding steps of the socket is restricted by the first corner and the second corner when the holder rotates in the first direction, and the protruding steps of the socket are inserted into the body by the third sidewall and the fourth sidewall when the holder rotates in a direction opposite the first direction.

* * * * *